US008782921B2

(12) United States Patent
Armenta-Pitsakis et al.

(10) Patent No.: US 8,782,921 B2
(45) Date of Patent: Jul. 22, 2014

(54) METHODS OF MAKING A HONEYCOMB STRUCTURE

(75) Inventors: Jesus Humberto Armenta-Pitsakis, Painted Post, NY (US); Valerie Jean Clark, Bath, NY (US); James Anthony Feldman, Campbell, NY (US); Jacob George, Horseheads, NY (US); Amit Halder, Ithaca, NY (US); Brett Alan Terwilliger, Corning, NY (US)

(73) Assignee: Corning Incorporated, Corning, NY (US)

( * ) Notice: Subject to any disclaimer, the term of this patent is extended or adjusted under 35 U.S.C. 154(b) by 275 days.

(21) Appl. No.: 13/535,748

(22) Filed: Jun. 28, 2012

(65) Prior Publication Data

US 2014/0000123 A1 Jan. 2, 2014

(51) Int. Cl.
*F26B 5/06* (2006.01)

(52) U.S. Cl.
USPC ..... 34/256; 34/259; 219/699; 264/434

(58) Field of Classification Search
USPC ..... 34/256, 259, 267, 380, 381, 411; 219/680, 693, 699, 729; 264/428, 434
See application file for complete search history.

(56) References Cited

U.S. PATENT DOCUMENTS

| | | | | |
|---|---|---|---|---|
| 5,388,345 | A * | 2/1995 | Brundage et al. | 34/256 |
| 6,259,078 | B1 * | 7/2001 | Araya | 219/709 |
| 6,539,644 | B1 * | 4/2003 | Araya | 34/259 |
| 6,808,663 | B2 * | 10/2004 | Noguchi et al. | 264/44 |
| 7,017,278 | B2 * | 3/2006 | Kato | 34/259 |
| 7,596,885 | B2 * | 10/2009 | Adrian et al. | 34/259 |
| 8,186,076 | B2 * | 5/2012 | Takagi | 34/264 |
| 8,729,436 | B2 * | 5/2014 | Adrian et al. | 219/681 |
| 2002/0139795 | A1 * | 10/2002 | Araya et al. | 219/680 |
| 2006/0042116 | A1 * | 3/2006 | Terazawa et al. | 34/259 |
| 2009/0235552 | A1 * | 9/2009 | Takagi et al. | 34/437 |
| 2011/0241263 | A1 * | 10/2011 | Takagi | 264/489 |
| 2014/0000123 | A1 * | 1/2014 | Armenta-Pitsakis et al. | 34/259 |

FOREIGN PATENT DOCUMENTS

| | | | |
|---|---|---|---|
| DE | 10 2011 016 066 | * | 6/2014 |
| EP | 2 168 741 | * | 3/2010 |
| JP | 2012106484 A | * | 6/2012 |
| WO | WO 2013/181058 | * | 12/2013 |

* cited by examiner

*Primary Examiner* — Steve M Gravini
(74) *Attorney, Agent, or Firm* — Charles A. Greene; Matthew J. Mason

(57) ABSTRACT

A method of making a honeycomb structure comprises the step of providing a honeycomb body including a first end face and a second end face, wherein the honeycomb body includes a ceramic and/or a ceramic-forming material. The method further includes the step of providing a first non-metallic extension and a second non-metallic extension along a longitudinal axis of the honeycomb body. The first non-metallic extension is positioned with respect to the first end face and the second non-metallic extension is positioned with respect to the second end face. The method further includes the step of exposing the honeycomb body and the non-metallic extensions to microwaves to dry the honeycomb body.

21 Claims, 4 Drawing Sheets

METHODS OF MAKING A HONEYCOMB STRUCTURE

TECHNICAL FIELD

The present disclosure relates to methods of making a honeycomb structure and, more particularly, to methods of making a honeycomb structure including the step of exposing a honeycomb body and extensions to microwaves to dry the honeycomb body.

BACKGROUND

Typical methods of making a ceramic honeycomb structure include the steps of extruding batch material into a green honeycomb body and then drying the green body to be subsequently fired into the ceramic honeycomb structure. Ceramic honeycomb structures can be used in a wide range of applications such as catalytic processing and/or particulate filtration of exhaust gases.

SUMMARY

In one example aspect, a method of making a honeycomb structure comprises step of providing a honeycomb body including a first end face and a second end face. The honeycomb body includes a ceramic and/or a ceramic-forming material. The method further includes the step of providing a first non-metallic extension and a second non-metallic extension along a longitudinal axis of the honeycomb body. The first non-metallic extension is positioned with respect to the first end face and the second non-metallic extension is positioned with respect to the second end face. The method further includes the step of exposing the honeycomb body and the non-metallic extensions to microwaves to dry the honeycomb body.

In another example aspect, a method of making a honeycomb structure comprises the step of providing a honeycomb body including a first end face and a second end face. The honeycomb body comprises a material having a first effective dielectric constant $\in_h$ expressed with a first real part $R_1$ and a first imaginary part $I_1$. The method further includes the step of providing a first extension and a second extension along a longitudinal axis of the honeycomb body. The first extension is positioned with respect to the first end face and the second extension is positioned with respect to the second end face. The first and second extensions each include a second dielectric constant $\in_e$ expressed with a second real part $R_2$ and a second imaginary part $I_2$. The method further includes the step of exposing the honeycomb body and the extensions to microwaves to dry the honeycomb body, wherein a real ratio R is defined as $R_1$ divided by $R_2$ prior to the step of drying, an imaginary ratio I is defined as $I_1$ divided by $I_2$ prior to the step of drying, and $3.7 \le R_1 \le 30.2$, $0.15 \le I_1 \le 3.6$, $0.16 \le R \le 6$ and $0.1 \le I \le 10000$.

In yet another example aspect, a method of making a honeycomb structure comprises the step of providing a honeycomb body including a first end portion including a first end face and a second end portion including a second end face. The honeycomb body includes a ceramic and/or ceramic-forming material having a material composition configured such that, when the honeycomb body is heated in an isolated manner through exposure to microwaves, drying efficiency is below a predetermined value at the first end portion and the second end portion of the honeycomb body. The method further includes the step of providing a first extension and a second extension along a longitudinal axis of the honeycomb body. The first extension is positioned with respect to the first end face and the second extension is positioned with respect to the second end face. The method further includes the step of exposing the honeycomb body and the extensions to microwaves to dry the honeycomb body, wherein drying efficiency that is below the predetermined value is confined to the first extension and the second extension.

BRIEF DESCRIPTION OF THE DRAWINGS

These and other aspects are better understood when the following detailed description is read with reference to the accompanying drawings, in which.

DETAILED DESCRIPTION

Figure 1:
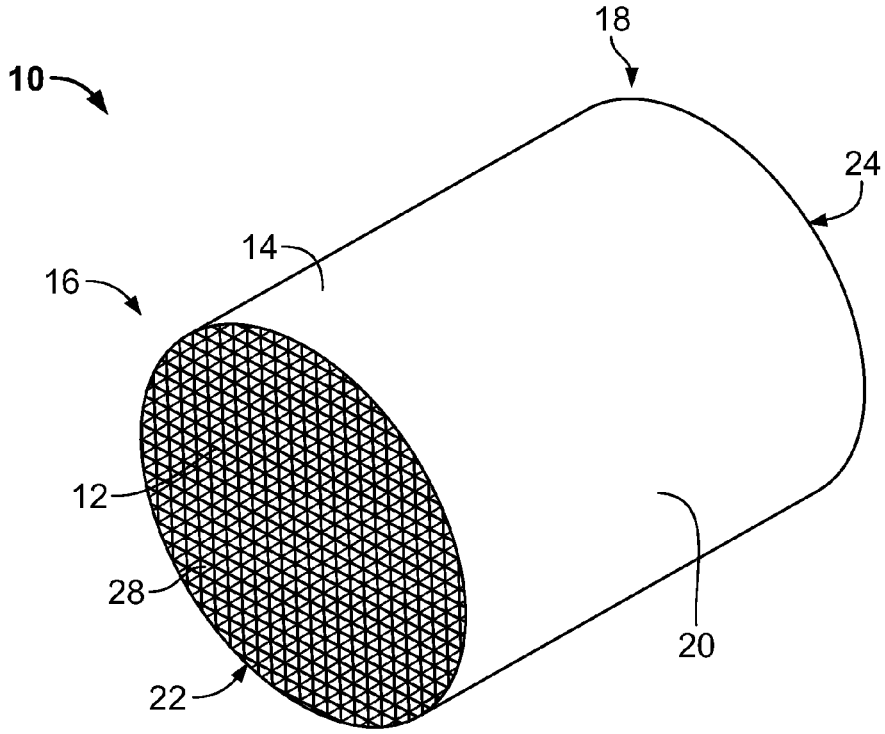
FIG. 1 is a perspective view of an example embodiment of a honeycomb body.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Referring now to FIG. 1, an example embodiment of a ceramic honeycomb structure made in accordance with aspects of the present application. The illustrated ceramic honeycomb structure can have a wide range of applications such as use as a catalytic structure and/or a particulate filter for processing exhaust from a combustion engine, such as a diesel engine.

FIG. 1 illustrates just one example ceramic honeycomb structure that can include a ceramic honeycomb body 10 with a matrix of intersecting cell walls 12 that in some examples may be thin and/or porous. The matrix of intersecting cell walls 12 can be configured to define a network of cells 28 comprising elongated channels. The cells can comprise a wide range of cross-sectional shapes such as curvilinear cell shapes, such as circular, oval or other curvilinear shapes. In further examples, the cells can comprise triangular, rectangular (e.g., square as shown in FIG. 1) or other polygonal cross-sectional shapes.

Still further, the intersecting cell walls 12 may optionally be surrounded by an outer wall 14. In the illustrated example, the honeycomb body 10 may be provided in a circular cross-sectional configuration including a first end 16, a second end 18 and a middle portion 20. While a circular cross-sectional configuration is shown, further examples can include an oval or other curvilinear shape. In still further examples, the outer periphery of the honeycomb body can comprise a polygonal shape, such as triangular, rectangular (e.g., square) or other polygonal configuration. As further shown, the honeycomb body 10 can comprise a monolithic body formed from a single piece although further examples can comprise a segmented configuration where a plurality of honeycomb body segments are mounted together to provide the overall peripheral shape of the honeycomb body.

A further shown, the walls 12 extend across and between a first end face 22 and an opposing second end face 24. The walls 12 form a large number of cells 28 comprising elongated hollow channels which extend between and are open at one or both of the end faces 22, 24 of the honeycomb body 10. The walls 12 that form the cells 28 may have a wide range of thicknesses. In some examples, the cell walls 12 can comprise relatively thin walls including a thickness of less than about 500 μm or less than about 250 μm, such as about 100 μm although other thicknesses may be provided in further examples. As shown, the first and second end faces 22, 24 can each extend along a respective cross-sectional plane that is perpendicular to the longitudinal axis of the honeycomb body 10. Although not shown, one or more of the first and second end faces may extend along a cross-sectional plane that is not perpendicular to the longitudinal axis of the honeycomb body 10. For instance, both the first and second end faces may extend along respective cross-sectional planes that are both angled with respect to the longitudinal axis of the honeycomb body 10 and are both parallel or angularly oriented with respect to one another. Still further as shown, while the end faces 22, 24 are shown to comprise substantially flat surfaces that extend along respective flat planes, in further examples, one or both of the end faces can extend along a non-flat surface. For example the end faces 22, 24 may be curved, such as convex, concave or other shaped surface.

Although not required in all examples, the ceramic honeycomb structure may be provided as a particulate filter. In such applications, each of the cells 28 may be sealed at one end. Indeed, a first subset of the cells 28 may be sealed at the first end face 22 and a second subset of the cells 28 being sealed at the second end face 24 of the body 10 with each cell 28 being sealed at only one of the first end face 22 and the second end face 24. Either of the end faces 22, 24 may be used as the inlet face of the resulting filter. In another example, the ceramic honeycomb structure may be provided as a catalytic structure that does not necessarily have a particulate filtering functionality. For instance, the cells may be open at both the first and second end face to allow the exhaust stream to be purified as it passes through the channels from the first end face to the second end face.

When making the ceramic honeycomb structure, a honeycomb body may be provided by an extrusion process although other processing techniques may be used in further examples to provide the honeycomb body. For instance, an extrusion process may be used to extrude a batch of ceramic and/or ceramic forming material through an extrusion die. In such examples, the outer wall 14 may optionally be co-extruded with the walls 12 such that the outer wall 14 and walls 12 are integrally formed together as a single co-extruded body. In further examples, the matrix of intersecting cell walls 12 may be initially extruded and the outer wall 14 may optionally be added during a subsequent processing technique.

Various batch material compositions may be provided for extrusion. For example, the batch material can comprise a paste and/or slurry, such as particles and/or powders mixed with polymer binders and/or low molecular weight liquids and combinations of these and other materials. Example batch materials can be configured from ceramic and/or ceramic forming materials configured to provide the ceramic honeycomb structure including cordierite, aluminum titanate or other ceramic or combinations thereof.

Once the green honeycomb body is provided (e.g., by extrusion), the green honeycomb body may be dried prior to firing to sinter the dried green honeycomb body into the ceramic honeycomb structure. In accordance with aspects of the disclosure, methods of the present application may be carried out by drying the green honeycomb body with microwaves to reduce the drying time and thereby increase production and efficiency in the manufacturing process.

Figure 3:
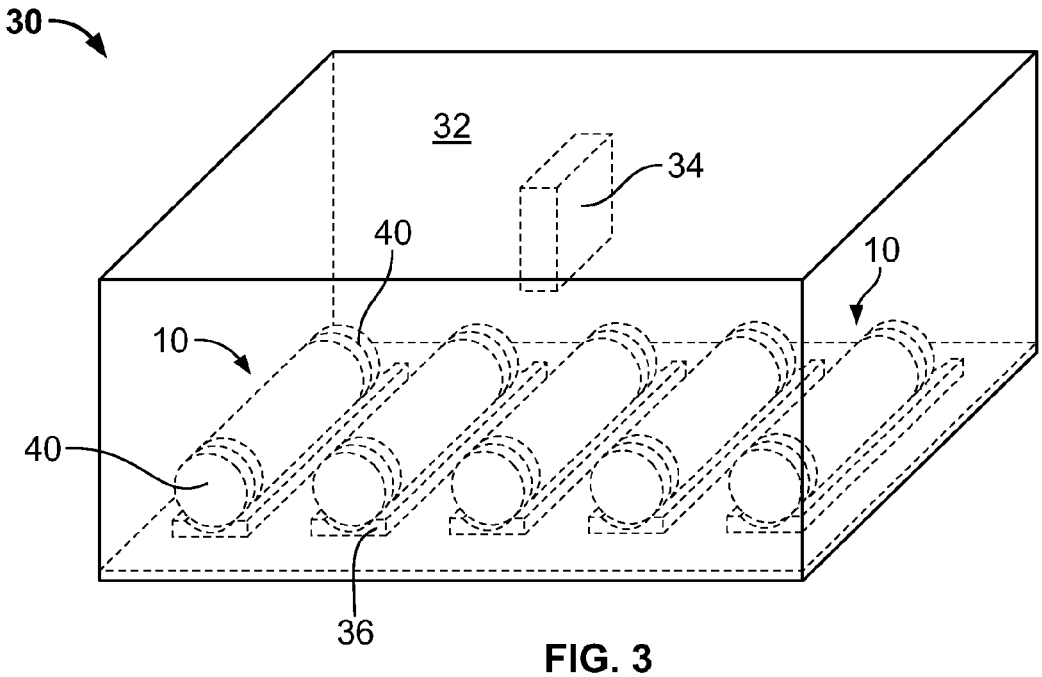
FIG. 3 is a perspective view of an example embodiment of a drying chamber in which the honeycomb bodies and the extensions can be arranged for exposure to microwaves.

FIG. 3 illustrates just one example apparatus 30 for drying green honeycomb bodies 10 by way of microwaves provided by a microwave generating source 34 schematically illustrated in FIG. 3. Various microwave sources may be provided in various examples. As illustrated, a single microwave source 34 may be provided although a plurality of microwave sources may be provided in further examples. For instance, an array or matrix of microwave sources may be provided to facilitating heating along the length of the green honeycomb body. In some examples, the microwave generating source 34 can be used to generate microwaves having a frequency ranging from 300 MHz to 300 GHz to facilitate a desired level of drying of the wet (e.g., damp) green honeycomb bodies 10. In one example, the frequency of the microwaves may be about 915 MHz in which case the wavelength of the microwaves would be about 0.328 m.

As further shown in FIG. 3, the apparatus 30 may include a microwave housing that provides a drying chamber 32 although drying may occur outside of a microwave chamber wherein microwave drying may be conducted outside of a drying chamber. If provided with a microwave housing, the microwave source 34 can be located at various positions relative to the microwave housing. For example, as shown, the microwave source 34 can be positioned near the top of the microwave housing although, in addition, or alternatively, the microwave source 34 may be located at the sides and/or bottom of the housing in further examples. As shown, the microwave source 34 can located within the drying chamber 32 although the microwave source may be located outside of the drying chamber in further examples. For instance, in one example, the microwave source can be located outside of the drying chamber wherein a microwave entry port may be provided to pass microwaves from the microwave source 34 into the drying chamber 32.

One or a plurality of green honeycomb bodies 10 may be oriented various ways relative to the microwave source 34. In one example, the desired orientation can be achieved by use of a cradle 36 configured to properly orient the green honeycomb body and prevent inadvertent rolling of the honeycomb body if provided with the illustrated circular cylindrical configuration. In one example, the cradles 36 may be positioned or mounted on a conveyor belt to allow continuous, indexing, or other movement routines of the green honeycomb bodies 10 relative to the drying chamber. In further examples, the cradles 36 may be placed within a bottom portion of the housing, wherein the green honeycomb bodies may be loaded onto the cradles 36 before beginning the drying process, and then unloaded from the cradles 36 after completing the drying process.

In one example, the apparatus 30 may be designed such that the microwave source 34 is configured to dry a single green honeycomb body one at a time, although, as shown in FIG. 3, the apparatus 30 may be configured to simultaneously dry a plurality of green honeycomb bodies 10. Indeed, FIG. 3 is schematically illustrated to dry a plurality of green honeycomb bodies 10 together wherein all of the honeycomb bodies begin and complete drying at substantially the same time. For instance, the plurality of honeycomb bodies 10 may be loaded on the cradles 36 within the drying chamber 32. Alternatively, a conveyor system may be activated to index a plurality of green honeycomb bodies 10 into the drying chamber. In some examples, previously dried honeycomb bodies maybe indexed out of the drying chamber while wet, such as damp, honeycomb bodies are indexed into the drying chamber 32. Once the wet green honeycomb bodies 10 are properly positioned within the drying chamber, as shown in FIG. 3, the microwave source 34 may then be activated to begin drying all of the green honeycomb bodies 10 together. Moisture content of the wet green honeycomb bodies 10 may be directly or indirectly monitored wherein the microwave source 34 can be discontinued, for example after a predetermined amount of time or when the moisture drops below a predetermined level. Once all of the green honeycomb bodies 10 are determined to have achieved a desired level of drying (e.g., substantially dry), the microwave source 34 can be deactivated and the dry green honeycomb bodies 10 can be removed from the drying chamber 32.

In further examples, the apparatus 30 may be designed to gradually dry a plurality of green honeycomb bodies 10 that are moved relative to the microwave source 34. For instance, the microwave source 34 may be moved (e.g., continuously) relative to a plurality of green honeycomb bodies to dry each of the green honeycomb bodies to complete drying at different times. In addition or alternatively, the green honeycomb bodies may be moved (e.g., continuously) relative to the microwave source 34. For example, the honeycomb bodies 10 together with the cradles 36, if provided, can be supported by a conveyor belt that moves (e.g., continuously) the green honeycomb bodies 10 relative to the microwave source 34. With reference to FIG. 3 for example, the cradles may be placed or mounted on the conveyor belt such that the conveyor belt can be moved such that the green bodies sequentially enter the drying chamber in a wet (e.g., damp) condition and then subsequently sequentially exit the drying chamber after a desired level of drying has occurred.

Figure 4:
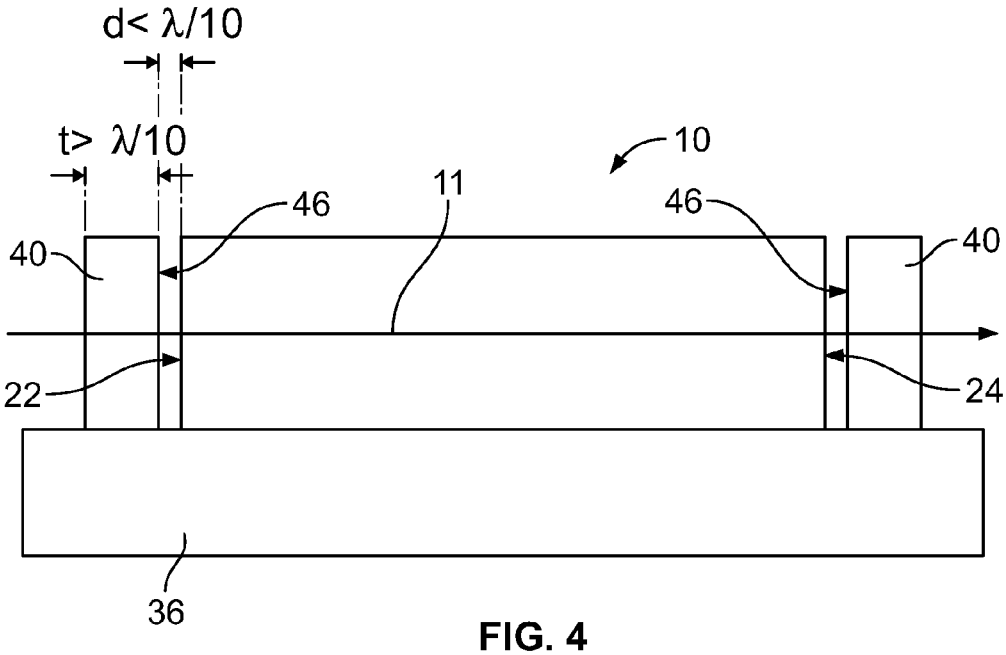
FIG. 4 is a close-up side view of an example embodiment of the extensions positioned with respect to the end faces of the honeycomb body.

As shown in FIGS. 3-4, the present disclosure contemplates placing extensions 40 along a longitudinal axis 11 of the honeycomb bodies 10. The extensions 40 may be made of material having a dielectric property identical or similar to the dielectric property of the material used to make the honeycomb body 10. The dielectric property of the material used to make the honeycomb body 10 may be expressed in complex number form as $\in_h (=R_1+iI_1)$ with a first real part $R_1$ and a first imaginary part $I_1$ while the dielectric constant of the material with which the extensions 40 are made may be expressed in complex number form as $\in_e (=R_2+iI_2)$ with a first real part $R_2$ and a first imaginary part $I_2$. The real part describes an energy storage capacity while the imaginary part describes an amount of attenuation offered by a material through various mechanisms. One example manner of selecting materials for the extensions 40 with similar dielectric property as the honeycomb bodies 10 is to use materials such that a real ratio R defined as $R_1$ divided by $R_2$ prior to the step of drying has a value between 0.16 and 6 where $3.7 \leq R_1 \leq 30.2$ and an imaginary ratio I defined as $I_1$ divided by $I_2$ prior to the step of drying has a value between $0.1 \leq I \leq 10000$ where $0.15 \leq I_1 \leq 3.6$. For example, the dielectric property of the material for the honeycomb body 10 may be 3.77+i0.15 or 30.2+i3.6 while the dielectric property of the material for the extensions 40 may be 6+i0.975, 5.3+i0.0006, 8+i0.0009 or 16+i2.6. In this manner, the extensions 40 can be made from not only ceramic or ceramic forming material similar or identical to the ceramic or ceramic forming material of the honeycomb bodies 10 but also other different types of material that may be different materials or compositions of the ceramic or ceramic forming material used to fabricate the honeycomb bodies 10 while still satisfying the above-referenced conditions. Of course, the above conditions may be changed, narrowed or broadened as more data regarding the suitability of materials are obtained.

Figure 5:
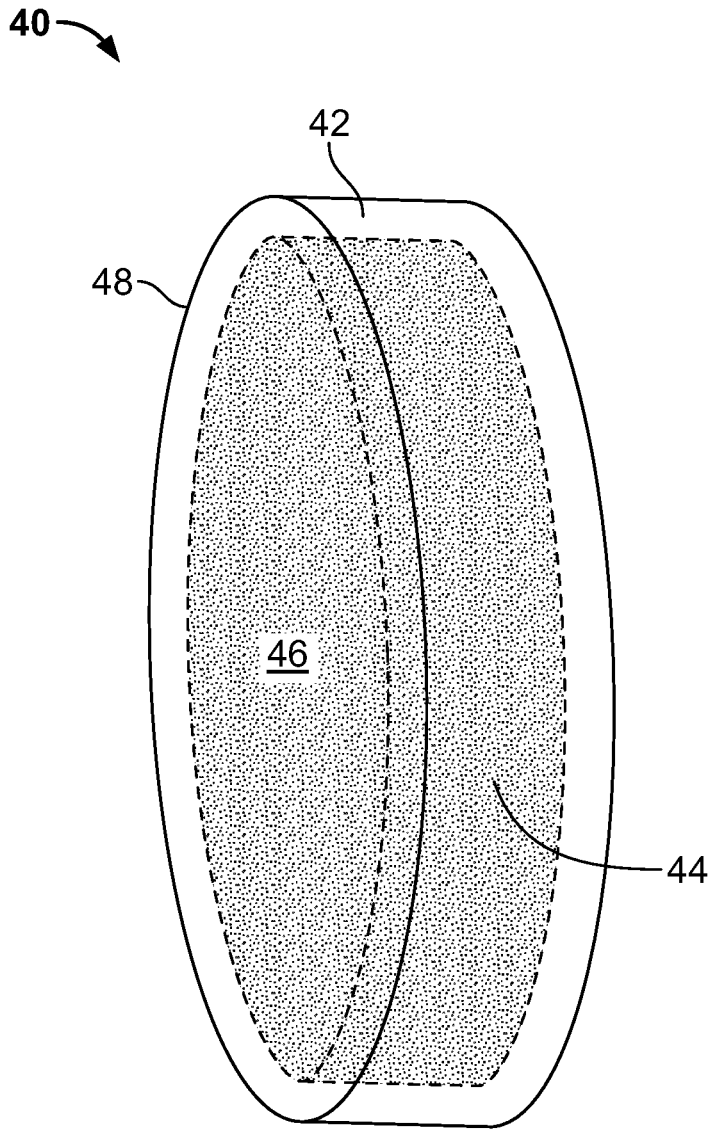
FIG. 5 is an isolated perspective view of an alternative example embodiment of the extension.

The following example embodiments for the extensions 40 can be contemplated. In a first example embodiment, the extensions 40 may be made of ceramic or ceramic-forming material that has undergone the same procedures used to prepare a green ware of the honeycomb body 10 up to and before the drying process except that the extension 40 is shaped to a different set of dimensions to be discussed below. As such, it is contemplated that some examples may provide the extensions 40 from substantially the same ceramic and/or ceramic forming material used to form the honeycomb body 10. In this embodiment, the dielectric properties of the honeycomb body 10 and the extensions 40 will be substantially identical. In a second example embodiment, the extensions 40 may be made of the same type of ceramic or ceramic-forming material and may have undergone the same or similar procedures except that the extension 40 has already been dried at least once, and in some examples, may be re-wetted for repeated use in the drying process. In a third example embodiment, the extensions 40 may include a casing 42 filled with powder 44 (FIG. 5) having similar dielectric property as the material of the green honeycomb bodies 10. In a fourth example embodiment, the extensions 40 may be made of a non-metallic, solid material, other than the material used to form the green honeycomb bodies, which cannot retain water. Providing the extensions 40 of a non-metallic material (e.g., ceramic or ceramic forming material or other material) can help the extensions 40 respond to microwaves in a manner similar to the green honeycomb bodies 10. The third and the fourth example embodiments of the extensions 40 may not have the porosity or other configuration to retain water.

The extensions 40 may optionally be cylindrical and have an extension face 46 with a similar or identical footprint to the footprint of the end faces 22, 24 of the honeycomb body 10. In one example, the extension faces 46 may include an outer periphery 48 that defines an area that is substantially the same as the area of the corresponding end face 22. As such, in some examples, the extension face 46 can be configured to cover substantially the entire area of the respective end face 22, 24 as shown in FIGS. 3 and 4. In further examples, the extension face 46 may have an area that is greater than or less than the area of the respective end face 22, 24. Furthermore, as shown in FIGS. 3 and 4, the shape of foot print of the extension face 46 is substantially circular and substantially matches the circular shape of the end faces 22, 24 of the green honeycomb bodies 10. In further examples, the shapes of the footprint may be different sizes but geometrically similar to one another (e.g., both circular with different diameters). In alternative examples, areas of the footprint may be the same or different with different geometric shapes. The extension face 46 of the extensions 40 illustrates as substantially flat although the extension face 46 may comprise a curved surface (e.g., concave, convex or other curved surface). Still further, the extension face 46 may be designed to substantially match the surface shape of the end faces 22, 24 of the honeycomb body 10. For example, the extension face 46 is illustrated as a substantially flat face that substantially matches the substantially flat face of the end faces 22, 24. In further examples, the extension face 46 may comprise a concave, convex or other curved surface that matches the concave, convex or other curved surface provided by the end faces 22, 24 of the honeycomb body 10.

Each of the extensions 40 may be positioned with respect to a corresponding end face 22 or 24 of the honeycomb body 10 such that the extension face 46 of the extensions 40 engages the end face 22 or 24 or is spaced apart from the end face 22 or 24 by a predetermined distance. Dimensions such as the thickness of the extension 40 and the predetermined distance by which the extension face 46 is spaced apart from the end face 22 or 24 can be correlated with the wavelength of the microwaves used to dry the honeycomb body 10. For example, the thickness t of the extension 40 may be more than 10% of the wavelength of the microwaves although even thinner extensions may be provided in further examples. Also, it must be noted that, in case of the third example embodiment of the extension 40 with a casing 42 filled with powder 44, the thickness of the extension 40 excludes the dimensions of the casing 42 and is measured in terms of the space filled by the powder 44.

As mentioned previously, the extension face 46 of the extensions 40 may engage the respective end face 22 or 24 of the honeycomb body. In further examples, the extension face 46 of the extensions 40 may be spaced apart by a predetermined distance d from the respective end face 22 or 24 without touching the respective end face 22 or 24. The predetermined distance d can vary depending on the particular application. For example, the predetermined distance d may be less than 25% of the wavelength of the microwaves in air, such as less than 10% of the wavelength of the microwaves in air. Although FIG. 4 shows the extensions 40 being spaced apart from the end faces 22 or 24 of the extensions 40, the extension face of the extension 40 can contact the end face 22 or 24 of the honeycomb body 10 as well as being spaced apart from the end face 22 or 24 and the term "with respect to" should be construed to encompass these two configurations. It is noted that some space between the extension face 46 of the extensions 40 and the end face 22, 24 of the honeycomb body 10 may be provided in various configurations to allow water to freely escape from the interior of the honeycomb body 10 during the drying process.

Once the extensions 40 are positioned relative to the honeycomb body 10 in the drying chamber 32 as described above, the honeycomb body 10 and the extensions 40 are dried by exposure to microwaves emitted by the microwave generating source 34. The exposure to microwaves may be maintained until the water in the green honeycomb body 10 is reduced to a desired level or a water content of the green honeycomb body 10 is reduced to substantially zero, for example. Depending on the embodiment of the extension 40, the extension 40 may also undergo drying. In embodiments of the extensions 40 that can contain water such as the extensions 40 made with ceramic or ceramic forming material, drying will take place similarly as in the honeycomb bodies 10 whereas in embodiments of the extensions 40 that include powder enclosed in a casing 42 or are formed from solid material that cannot retain water might not undergo drying.

While one example manner is to place the extensions 40 next to the honeycomb bodies 10 from the very beginning of the drying process, it is also possible to delay the placement of the extensions 40. However, the extensions 40 should be placed next to the honeycomb bodies 10 before the dryness of the honeycomb bodies 10 reaches 60%.

Figure 6:
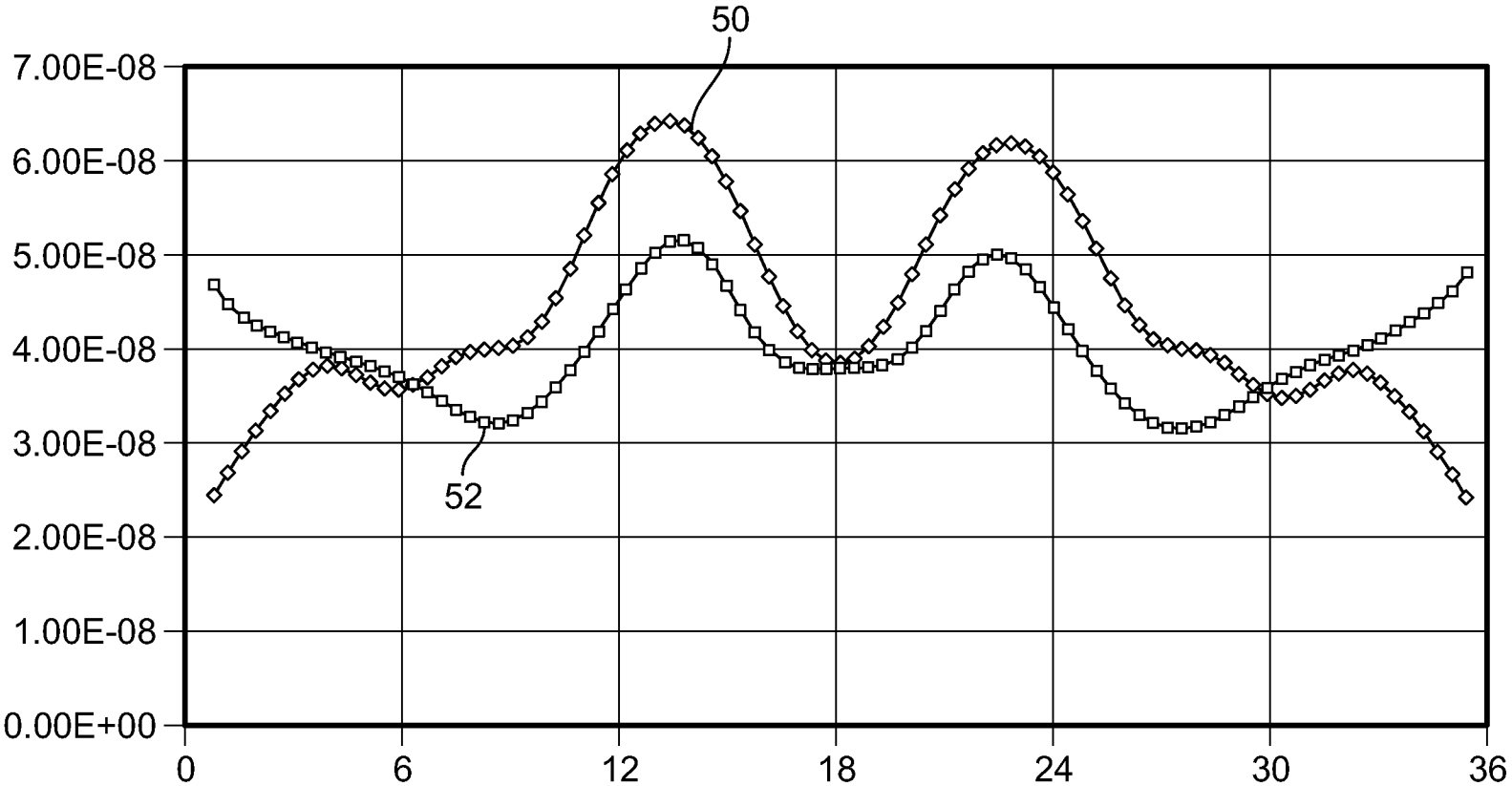
FIG. 6 is a graph showing scaled integrated power dissipation versus honeycomb body length for a honeycomb body dried with the extensions and another honeycomb body dried without the extensions.

FIG. 6 is a graph demonstrating scaled integrated power dissipation (Watts/minute) along the vertical axis with respect to the length of the honeycomb body 10 (inches) along the horizontal axis. As shown, the graph demonstrates integrated power dissipation at various positions along a honeycomb body 10 having a length of 36 inches wherein the "0 inch" position is associated with the first end face 22 and the "36 inch" position is associated with the second end face 24 of the honeycomb body 10. The integrated power dissipation indicates the power that is dissipated (i.e., heat) at a given point along the length of the honeycomb body 10 and is obtained by integration over the cross-sectional area of the honeycomb body 10 at each given point. For honeycomb bodies 10 made of ceramic or ceramic forming material including small amounts of graphite (about 30% or less), it is observed that, when the green honeycomb body 10 is exposed to microwaves in an isolated manner without the extensions 40 positioned with respect to the end faces 22, 24, the portions of the honeycomb bodies 10 near the end faces 22, 24 experience low drying efficiency as shown by line 50 in FIG. 6. However, when the green honeycomb body 10 with similar graphite composition is exposed to microwaves with the extensions 40 dimensioned as described above and positioned with respect to the end faces 22, 24, it is observed that the low drying efficiency is confined to the extensions 40 rather than the portions of the honeycomb body 10 near the end faces 22, 24. Thus, although the integrated power dissipation along the thickness of the extensions 40 is not shown by line 52 of FIG. 6, it is possible to maintain the drying efficiency above a predetermined value throughout the entire length of the honeycomb body 10 and accomplish a more uniform drying of the honeycomb body 10. Moreover, by placing the extensions 40 with respect to the end faces 22, 24 and controlling the thickness of the extensions 40, it is possible to keep the drying efficiency experienced by the ends 16, 18 and the middle portion 20 above a desired value.

Figure 2:
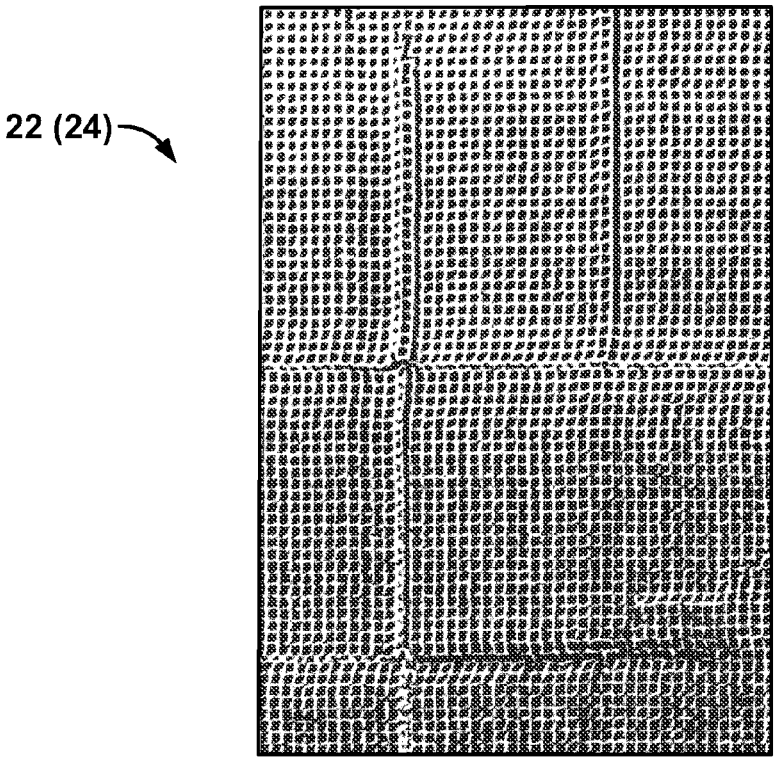
FIG. 2 is a top view of a portion of an end face of the honeycomb body that was dried by exposure to microwaves in an isolated manner without an extension positioned with respect to the end face.

In accordance with aspects of the disclosure, microwave heating to achieve a desired level of drying of a green honeycomb body can be used to achieve higher volumetric heating uniformity than conduction and/or convection heating can provide alone, while at the same time offering low operating costs and reduced processing times. Moreover, placing extensions along a longitudinal axis of the honeycomb body with respect to the end faces of the honeycomb body can allow microwave drying without deformation of cells near the ends 16, 18 that may otherwise occur without use of the extensions discussed herein. Indeed, some ceramic materials that are useful for constructing ceramic structures and filters contain small amounts of graphite (e.g., about 10-30% or even less of the composition). The extensions 40 discussed herein can compensate for otherwise low drying efficiency that may occur near the ends 16, 18 of the honeycomb body 10. As such, the extensions 40 can avoid excessive moisture that may otherwise remain near the ends 16, 18 after the drying process than in the middle portion 20. Moreover, the extensions 40 can avoid excessive drying that may otherwise occur with honeycomb bodies 10 with larger amounts of graphite. As such, the extension 40 can avoid uneven drying along the length of the honeycomb body that may otherwise result in deformed cells (e.g., see FIG. 2). Still further, since more even drying can be achieved by use of the extensions, deformity of the cell structure at the end faces 22, 24 can be avoided. Avoiding damage to the cell structure at the end faces 22, 24 can be beneficial to enhance performance of the honeycomb structures and avoid product waste and additional manufacturing time that may otherwise be needed to cut of the end portions of the honeycomb by that include the deformed cell structure.

In examples of the disclosure, including examples discussed above, methods of the disclosure can comprise making a honeycomb structure comprising the steps of providing honeycomb body including a first end portion including a first end face and a second end portion including a second end face. In such examples, the honeycomb body includes a ceramic and/or ceramic-forming material having a material composition configured such that, when the honeycomb body is heated in an isolated manner through exposure to microwaves, drying efficiency is below a predetermined value at the first end portion and the second end portion of the honeycomb body. The method further includes the step of providing a first extension and a second extension along a longitudinal axis of the honeycomb body, wherein the first extension is positioned with respect to the first end face and the second extension is positioned with respect to the second end face. The method further includes the step of exposing the honeycomb body and the extensions to microwaves to dry the honeycomb body. In such examples, drying efficiency that is below the predetermined value is confined to the first extension and the second extension.

Once sufficiently dried, for example, at least partially with one or more of the techniques discussed above, the dried green honeycomb body can then be fired into the honeycomb ceramic structure. Further processing may then be carried out to allow the honeycomb ceramic structure to be used in accordance with the desired application.

It will be apparent to those skilled in the art that various modifications and variations can be made without departing from the spirit and scope of the claimed invention.

What is claimed is:

1. A method of making a honeycomb structure comprising steps of:

providing a honeycomb body including a first end face and a second end face, wherein the honeycomb body includes a ceramic and/or a ceramic-forming material;

providing a first non-metallic extension and a second non-metallic extension along a longitudinal axis of the honeycomb body, wherein the first non-metallic extension is positioned with respect to the first end face and the second non-metallic extension is positioned with respect to the second end face; and exposing the honeycomb body and the non-metallic extensions to microwaves to dry the honeycomb body.

2. The method of claim 1, wherein at least one of the first non-metallic extension and the second non-metallic extension is spaced apart a distance from a respective one of the first end face and the second end face of the honeycomb body.

3. The method of claim 2, wherein the distance is less than a quarter of the wavelength of the microwaves in air.

4. The method of claim 3, wherein the distance is less than one-tenth of the wavelength of the microwaves in air.

5. The method of claim 1, wherein the first non-metallic extension includes a first outer periphery defining a first area facing the first end face and the second non-metallic extension includes a second outer periphery defining a second area facing the second end face, and wherein at least one of the first area and the second area is at least as large as an area of a respective one of the first end face and the second end face of the honeycomb body.

6. The method of claim 1, wherein the first non-metallic extension includes a first thickness and the second non-metallic extension includes a second thickness, wherein each of the first thickness and the second thickness is more than one-tenth of the wavelength of the microwaves in air.

7. The method of claim 1, wherein the non-metallic extensions include a ceramic and/or a ceramic-forming material.

8. The method of claim 1, wherein the step of exposing the honeycomb body and the non-metallic extensions to microwaves further dries the non-metallic extensions.

9. The method of claim 1, wherein the honeycomb body contains less than about 30% graphite.

10. The method of claim 9, wherein the honeycomb body contains less than about 10% graphite.

11. The method of claim 1, wherein the honeycomb body includes a cell wall thickness of less than about 500 μm.

12. The method of claim 11, wherein the cell wall thickness is less than about 250 μm.

13. The method of claim 12, wherein the cell wall thickness is about 100 μm.

14. The method of claim 1, wherein the microwaves have a frequency of about 300 MHz to about 300 GHz.

15. The method of claim 1, further comprising the step of firing the dried honeycomb body into a honeycomb ceramic structure.

16. A method of making a honeycomb structure comprising the steps of:

providing a honeycomb body including a first end face and a second end face, the honeycomb body comprising a material having a first effective dielectric constant $\in_h$ expressed with a first real part $R_1$ and a first imaginary part $I_1$;

providing a first extension and a second extension along a longitudinal axis of the honeycomb body, wherein the first extension is positioned with respect to the first end face and the second extension is positioned with respect to the second end face, wherein the first and second extensions each include a second dielectric constant $\in_e$ expressed with a second real part $R_2$ and a second imaginary part $I_2$; and exposing the honeycomb body and the extensions to microwaves to dry the honeycomb body, wherein a real ratio R is defined as $R_1$ divided by $R_2$ prior to the step of drying, an imaginary ratio I is defined as $I_1$ divided by $I_2$ prior to the step of drying, and $3.7 \leq R_1 \leq 30.2$, $0.15 \leq I_1 \leq 3.6$, $0.16 \leq R \leq 6$ and $0.1 \leq I \leq 10000$.

17. The method of claim 16, wherein the extensions include a ceramic and/or a ceramic-forming material.

18. The method of claim 16, wherein the step of exposing the honeycomb body and the extensions to microwaves further dries the extensions.

19. The method of claim 16, wherein the extensions each include a casing in which powder having the second dielectric constant $\in_e$ is placed.

20. The method of claim 16, further comprising the step of firing the dried honeycomb body into a honeycomb ceramic structure.

21. A method of making a honeycomb structure comprising the steps of:

providing honeycomb body including a first end portion including a first end face and a second end portion including a second end face, wherein the honeycomb body includes a ceramic and/or ceramic-forming material having a material composition configured such that, when the honeycomb body is heated in an isolated manner through exposure to microwaves, drying efficiency is below a predetermined value at the first end portion and the second end portion of the honeycomb body;

providing a first extension and a second extension along a longitudinal axis of the honeycomb body, wherein the first extension is positioned with respect to the first end face and the second extension is positioned with respect to the second end face; and exposing the honeycomb body and the extensions to microwaves to dry the honeycomb body, wherein drying efficiency that is below the predetermined value is confined to the first extension and the second extension.

* * * * *